US007712714B2

(12) United States Patent
Jackson et al.

(10) Patent No.: US 7,712,714 B2
(45) Date of Patent: May 11, 2010

(54) ADJUSTABLE CONNECTOR FOR MARINE ACCESSORIES

(75) Inventors: Scott A. Jackson, Knoxville, TN (US); Thomas J. Jackson, Knoxville, TN (US); Steven W. Jackson, Knoxville, TN (US); John R. Jackson, Knoxville, TN (US)

(73) Assignee: J&J Machine & Tool, Inc., Knoxville, TN (US)

( * ) Notice: Subject to any disclaimer, the term of this patent is extended or adjusted under 35 U.S.C. 154(b) by 678 days.

(21) Appl. No.: 11/533,731

(22) Filed: Sep. 20, 2006

(65) Prior Publication Data

US 2007/0066144 A1 Mar. 22, 2007

Related U.S. Application Data

(60) Provisional application No. 60/719,149, filed on Sep. 21, 2005.

(51) Int. Cl.
*F16C 11/00* (2006.01)

(52) U.S. Cl. ..... 248/229.1; 248/284.1; 16/326; 403/97

(58) Field of Classification Search ..... 248/229.1, 248/276.1, 278.1, 292.12, 291.1, 284.1; 403/96, 403/84, 97; 16/111 R, 326, 329
See application file for complete search history.

(56) References Cited

U.S. PATENT DOCUMENTS 5,039,118 A * 8/1991 Huang ..... 280/47.371
5,062,179 A * 11/1991 Huang ..... 16/436
5,542,151 A * 8/1996 Stranski et al. ..... 16/326
5,551,660 A * 9/1996 Leduchowski ..... 248/276.1
5,826,908 A * 10/1998 McBride ..... 280/814
5,964,439 A * 10/1999 Johnson ..... 248/278.1
6,209,835 B1 * 4/2001 Walrath et al. ..... 248/276.1
6,629,801 B2 * 10/2003 Cheng ..... 403/101
6,669,155 B2 * 12/2003 Ron ..... 248/276.1
6,802,328 B2 * 10/2004 Lin ..... 135/96
6,886,795 B2 5/2005 Schultz
7,367,740 B2 * 5/2008 Lazic et al. ..... 403/97

* cited by examiner

*Primary Examiner*—Anita M King
(74) *Attorney, Agent, or Firm*—Knox Patents; Thomas A. Kulaga

(57) ABSTRACT

An apparatus for adjustably securing a boat accessory to a boat. A first member has a plug and a second member has a socket. The plug has a rosette shape with rounded protrusions and the socket has a corresponding mating shape. Both the plug and the socket have openings for a fastener to secure the plug in the socket. The first member is one of a mounting base and an accessory base, and the second member is the other one. In one embodiment, an extension is positioned adjacent the plug so as to separate the first and second members. In another embodiment, the extension has a plug on each end and the first and second members have sockets. In another such embodiment, the extension has two members joined with a rosette-shaped plug and socket.

13 Claims, 7 Drawing Sheets

ADJUSTABLE CONNECTOR FOR MARINE ACCESSORIES

CROSS-REFERENCE TO RELATED APPLICATIONS

This Application claims the benefit of U.S. Provisional Application No. 60/719,149, filed on Sep. 21, 2005.

STATEMENT REGARDING FEDERALLY SPONSORED RESEARCH OR DEVELOPMENT

Not Applicable

BACKGROUND OF THE INVENTION

1. Field of Invention

This invention pertains to an adjustable connector for attaching accessories, such as a wakeboard holder, to a water vessel, such as a recreational boat. More particularly, this invention pertains to an adjustable connector including a plug that mates with a socket and provides rotational adjustment about the longitudinal axis of the plug relative to the socket.

2. Description of the Related Art

Water vessels, such as recreational boats, include various accessories, such as wakeboard holders, speakers, lights, mirrors, and such. One common and popular boat accessory is a wakeboard holder, which is commonly a rack that clamps one or more wakeboards when not being used. One example of such a wakeboard holder is U.S. Pat. No. 6,886,795, issued to Schultz on May 3, 2005, titled "Accessory storage device," which discloses a storage device that is used in pairs to hold wakeboards and other planar objects. Each storage device is a fork with a clamping member that is forced against a wakeboard when a handle is operated. The storage device is secured to a planar member that is a mounting structure, which is part of the boat.

Boat accessories are mounted to the boat at various locations and to various members of the boat, for example, towers, stanchions, decks, windshield frames, and railings. Due to the custom nature of many boats, single application or custom made brackets and supports are often used to support accessories. For example, a boat tower may have speakers that are attached to the tower by way of a mounting connecter that clamps to the tower and bolts to the speaker box. Oftentimes, the custom brackets and supports offer little or no adjustability if the boat operator desires to reposition the accessory, such as, for example, when the speaker is rear facing and the boat operator desires to have the speaker be side facing. Accordingly, one problem with attaching accessories to a boat is how to adjust the positioning of the accessory with an esthetically pleasing connector, with the connector having the strength to withstand the pounding and vibration that such accessories are subject to on a boat.

Known devices that attempt to solve this problem include cylindrical plugs with smooth sidewalls engaging cylindrical sockets, also with smooth sidewalls. The plugs are secured in the sockets with pins inserted in corresponding holes in the plug and socket. The pins are parallel to and offset from the longitudinal axis of the cylindrical plugs. A plurality of holes in either or both of the plug and the socket allow the plug to assume one of several fixed positions relative to the socket. One problem with this solution is the difficulty in aligning the pin with the hole when inserting the plug into the socket. Another problem is that the pins are susceptible to shearing when excessive rotational force is applied.

BRIEF SUMMARY OF THE INVENTION

According to one embodiment of the present invention, an adjustable connector for boat accessories is provided. The adjustable connector allows at least two degrees of freedom for adjusting the accessory. In one embodiment, the connector has a clamping base configured to clamp to a tubular member, such as a boat tower or stanchion. The clamping base, in one embodiment, rotates around the tubular member when unclamped and is configured to lock, or clamp, when the desired orientation is achieved. The clamping base includes one of a plug or a socket. The clamping base attaches to an accessory base, which includes the other of the plug or socket.

The plug has a cylindrical end portion that includes a plurality of regularly spaced rounded protrusions. In one embodiment, the plug has a rosette-shape, when viewed from the end. The plug has a longitudinal axis that is coaxial with the cylindrical end portion and an opening for receiving a fastener.

The socket has a recess that includes a plurality of regularly spaced rounded recesses dimensioned and configured to receive the cylindrical end portion. The socket has a longitudinal axis that is coaxial with the recess and an opening for receiving the fastener. With the plug engaging the socket, rotation about the longitudinal axes is inhibited by the plurality of regularly spaced rounded protrusions engaging the plurality of regularly spaced rounded recesses. The fastener engages the openings in the plug and the socket to secure the plug and socket in a fixed relationship. The plug and socket allow one degree of freedom by disengaging the plug from the socket and rotating the plug about its longitudinal axis until the regularly spaced rounded protrusions align with the regularly spaced rounded recesses with the accessory base in the desired orientation. The plug is then re-engaged with the socket and the two bases are held in a fixed relationship.

In another embodiment, the plug is attached to an extension that allows the clamping base to be separated from the accessory base. In one such embodiment, the extension has two members. The two members are joined by a plug and socket oriented such that the longitudinal axes of the plug and socket are perpendicular to the longitudinal axis of each member. The plug and socket of the extension give the adjustable connector another degree of freedom by allowing the longitudinal axis of one member to form an angle relative to the longitudinal axis of the other member.

One type of accessory that the adjustable connector is suitable for securing is a wakeboard holder that receives a wakeboard and secures it in a stowed position. The wakeboard holder has two substantially rectangular end-pieces and a center clamping assembly, all supported on a base. The end-pieces are sufficiently wide to secure a wakeboard without requiring additional support of the wakeboard. The center clamping assembly includes a box with two pairs of clamping tangs positioned on opposite sides of the box. The clamping tangs are spring loaded such that in the normal position each clamping tang projects toward one of the two end-pieces. An operator forces a wedging member between opposing pairs of clamping tangs, which causes the clamping tangs to retract toward the box and release any object clamped between the clamping tang and the end-pieces.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
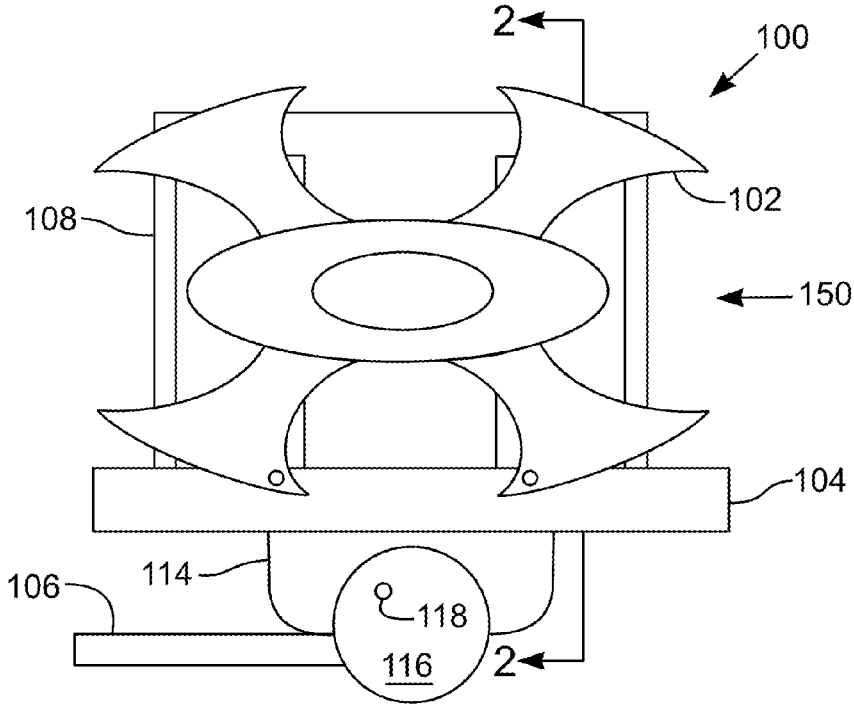
FIG. 1 is a side view of one embodiment of a wakeboard holder.

An apparatus for securing boat accessories to a boat that is both adjustable and strong is disclosed. Accessories, such as wakeboard holders, are often attached to recreational watercraft. An adjustable connector, generally shown as 200 in the drawings, allows such accessories to be conveniently attached to a boat, while allowing the position of the accessory to be conveniently positioned.

FIG. 1 illustrates a side view of one embodiment of a wakeboard holder 100 that includes a wakeboard holder clamping assembly 150. The clamping assembly 150 includes a pair of end-pieces, or side panels, 102 attached to a base member 104. Between the end-pieces, or side panels, 102 is a clamping assembly box 108. Below the base 104 is an operator support 114 and an operator 116. A handle 106 is a lever attached to the operator 116. The operator 116 rotates within the operator support 114. In the position shown, the handle 106 allows the wakeboard holder 100 to clamp a wakeboard positioned between the clamping assembly box 108 and one of the pair of end-pieces 102. The handle 106 moves down to un-clamp the boards in the wakeboard holder 100.

In the illustrated embodiment, the side panels 102 have a stylistic "X" shape that is ornamental. In other embodiments, the side panels 102 are dimensioned and configured to provide support to and secure the wakeboards in the clamping assembly 150.

Figure 2:
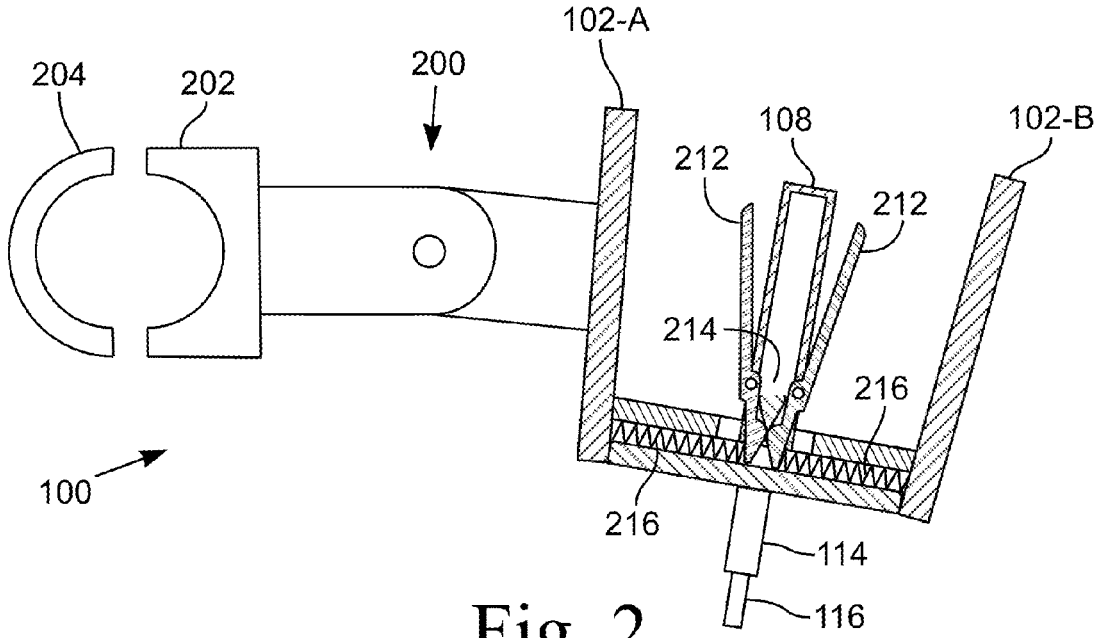
FIG. 2 is a cross-sectional view of the wakeboard holder.

FIG. 2 illustrates a cross-sectional view of the wakeboard holder 100 showing the adjustable connector assembly 200 connecting one of the side panels 102-A to the clamp 202, 204 that secures the wakeboard holder 100 to the vessel. In various embodiments, the opening in the clamp 202, 204 has other configurations and shapes depending upon the shape of the member to which the holder 100 is to be clamped. The illustrated embodiment of the adjustable connector assembly 200 allows four degrees of freedom, or adjustment, for positioning the wakeboard holder clamping assembly 150.

The clamping assembly 150 includes the two side panels 102, the base 104, and the clamping assembly box 108. The inside surface of the two panels 102 include a resilient backing material to avoid marring the surface of the wakeboards during clamping. The clamping assembly box 108 includes pivoting tangs 212 that are biased by springs 216 to the clamping position as illustrated. The springs 216 are positioned in bores in the base 104.

In operation, a wakeboard is positioned between one side panel 102 and the clamping assembly box 108 with the tangs 212 in the unclamped position, that is, with the handle 106 in the down position. When the tangs 212 are released to their normal position, that is, with the handle 106 in the up position, the springs 216 bias, or force, the tangs 212 against one side of the wakeboard, thereby wedging the wakeboard between the tangs 212 and the side panel 102.

Figure 3:
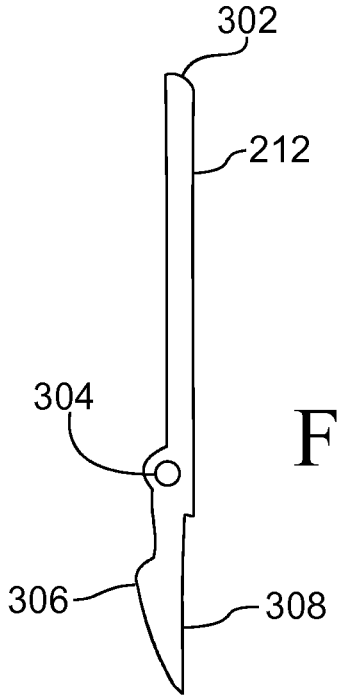
FIG. 3 is a side view of one embodiment of a clamping tang.

FIG. 3 illustrates a side view of one embodiment of a clamping tang 212. Referring to FIG. 2, the end of the clamping assembly box 108 positioned between the two side panels 102-A, 102-B is illustrated cut-away to show a pair of clamping tangs 212. The clamping tangs 212 have a pivot 304 about which the tangs 212 rotate. The operator 116 forces a wedge 214 to move between the pair of tangs 212, engaging the cam surfaces 306 and forcing the bottom 308 of the tangs 212 to separate, thereby bringing the opposite end 302 of the pair of tangs 212 together and releasing any wakeboard clamped in the holder 100. The top end 302 of the tang 212 is radiused where the tang 212 potentially contacts the wakeboard when in the clamped position. At the opposite end, the tang 212 has a cam, or rounded, surface 306 upon which the wedge 214 rides.

A pair of tangs 212 are positioned to oppose each other, with the wedge 214 acting equally on each one of the pair of tangs 212. The pair of tangs 212 are biased by a pair of springs 216 that are positioned in a bore in the base 104. The pair of springs 216 bias the bottoms 308 of the tangs 212 such that the tangs 212 are normally positioned in a clamping position as illustrated in FIG. 2. As the wedge 214 moves downward along the rounded surface 306 of the tang 212, the bottom 308 of the tang 212 forces the spring 216 to compress as the pair of tangs 212 are moved to a parallel relationship.

Figure 4:
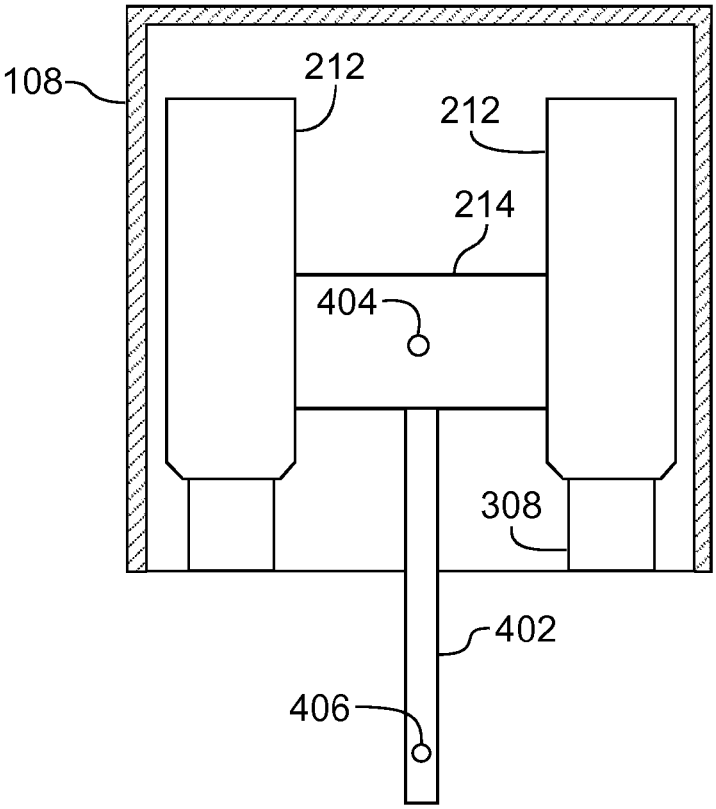
FIG. 4 is a front view of a pair of clamping tangs as seen inside the center box.

FIG. 4 illustrates a front view of a pair of clamping tangs 212 as seen inside the cut-away clamping assembly box 108. FIG. 4 shows only the side face of the box 108 cut-away, showing the tangs 212 and the wedge 214. The side face of the clamping assembly box 108 has openings into which the tangs 212 fit. Two tangs 212 are spaced apart on the side of the center box 108. Each of the two tangs 212 form half of a pair of tangs 212 with each one of the pair of tangs 212 facing one of the side panels 102-A, 102-B.

The wedge 214, seen in profile in FIG. 2, extends between each one of the pairs of tangs 212 adjacent the cam surface 306. The wedge 214 is attached to a shaft 402 with a pin 404. The opposite end of the shaft 402 has an opening 406 for receiving another pin that attaches the shaft 402 to the opening 118 in the operator 116.

Figure 5:
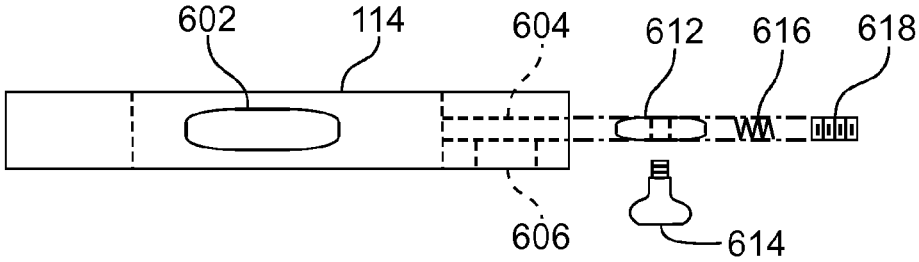
FIG. 5 is a top exploded view of one embodiment of an operator support.
Figure 6:
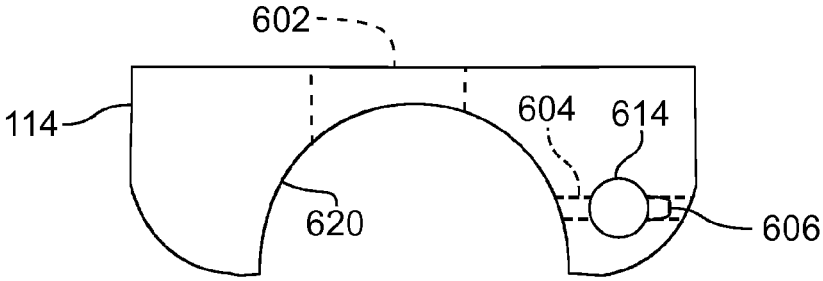
FIG. 6 is a side view of the operator support with locking mechanism.

FIG. 5 illustrates an exploded top view of one embodiment of an operator support 114. FIG. 6 illustrates a side view of the operator support 114 showing one embodiment of a locking mechanism. The operator support 114 attaches to the bottom of the base 104 and has a slot 602 through which the shaft 402 passes. The locking mechanism includes a sliding pin 612 into which a knob, or handle, 614 is attached. The sliding pin 612 butts against a spring 616, which has an opposite end against a setscrew 618, thereby biasing the sliding pin 612 away from the setscrew 618. The sliding pin 612, the spring 616, and the setscrew 618 are received by the bore 604 in the operator support 114. A portion of the handle 614 protrudes through the slotted opening 606 on the side of the operator support 114 whereby the pin 612 is held captive by the handle 614 and is biased by the spring 616 such that the pin 612 protrudes past the inside surface 620 of the operator support 114 when in the lock position.

Figure 7A:
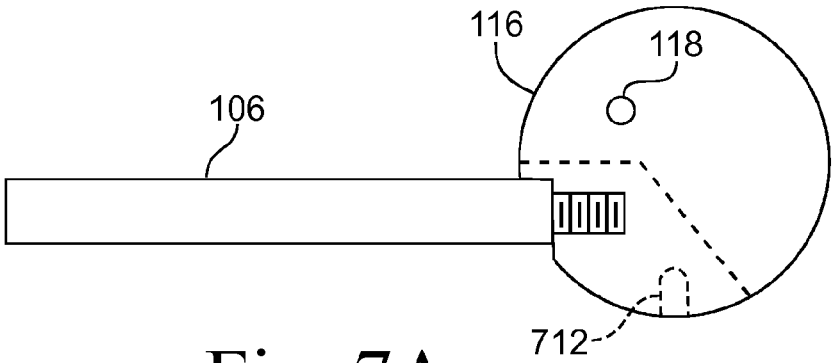
FIG. 7A is a side view of one embodiment of an operator and handle.
Figure 7B:
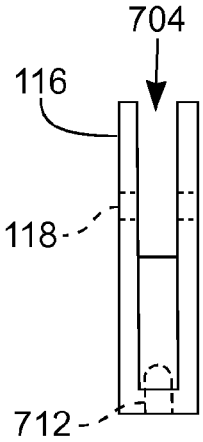
FIG. 7B is an end view of the operator.

FIG. 7A illustrates a side view of one embodiment of an operator 116 and handle 106. FIG. 7B illustrates an end view of the operator 116. The operator 116 is disk-shaped and is dimensioned to be received by the cut-out 620 in the operator support 114. The operator 116 rotates within the cut-out 620 in the operator support 114. The operator 116 has a central opening 704 in which the shaft 402 is free to move as the operator 116 rotates. Visible in the side of the operator 116 is a through-opening 118 which receives a pin that pivotally connects the shaft 402 to the operator 116. The handle 106 is attached to the operator 114 whereby the handle 106 causes the operator 116 to rotate within the operator support 114.

As the operator 116 rotates within the cut-out 620, the through-opening 118 rotates such that the opening 118 is displaced away from the base pulling the shaft 402 downward, thereby causing the wedge 214 to move toward the base 104 and forcing the bottom 308 of the tangs 212 away from each other. As the operator 114 rotates and causes the tangs 212 to assume the un-clamped position, the opening 712 in the operator 114 moves adjacent the sliding, spring-biased pin 612, which is then forced into the opening 712. The pin 612 locks the operator 114 and prevents rotation, causing the tangs 212 to be locked in the un-clamped position. To release the operator 114 and allow the tangs 212 to return to the clamped position, the knob 614 is moved away from the operator 114, causing the pin 612 to disengage the opening 712 in the operator 114.

In operation, the wakeboard holder 100 is configured to clamp a board between one of the side panels 102 and the center box 108. To insert a board into the holder 100, the handle 106 is pulled down until it is locked in place by the locking pin 616. As the handle 106 moves, the shaft 402 moves also, forcing the wedge 214 between the rounded surfaces 306 of each pair of spring-loaded tangs 212. The wedge 214 causes the tangs 212 to move into the in-clamped position.

With the handle 106 in the operated position, the clamping tangs 212 are in the unclamped position with the outside surface of the tangs 212 flush with the outside surface of the central box 108. A wakeboard is inserted between one of the side panels 102 and the central box 108. The locking handle 614 is moved to retract the pin 612 from the operator 116, allowing the handle 106 to return to its normal position. By returning the handle 106 to the clamped position, the thicker portion of the wedge 214 is moved away from the rounded surface 306 of the pair of tangs 212, allowing the springs 216 to force the tangs 212 against the board, thereby wedging the board between the tangs 212 and the side panel 102.

In one embodiment, the inside surface of the side panels 102, the outside surface of the central box 108, and the outside surface of the tangs 212 are covered with a resilient material in order to minimize any scratching or other damage to the wakeboards secured in the wakeboard holder 100.

Figure 8:
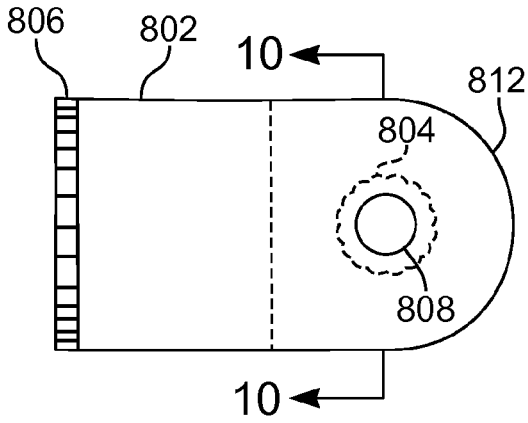
FIG. 8 is a side view of one embodiment of one half of the adjustable connector.
Figure 9:
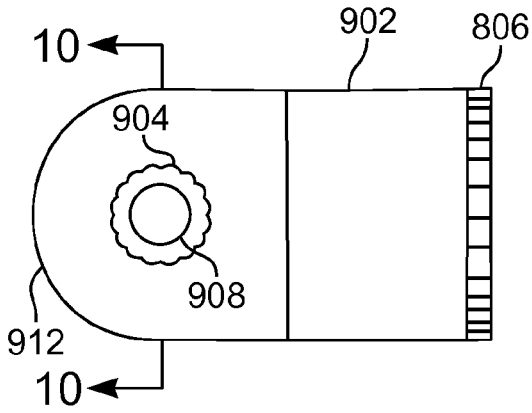
FIG. 9 is a side view of one embodiment of the other half of the adjustable connector.
Figure 10:
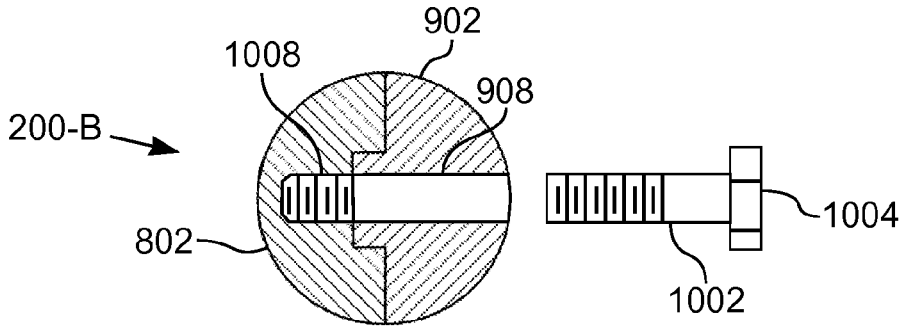
FIG. 10 is a cross-sectional view of one embodiment of the extension of an adjustable connector.
Figure 11:
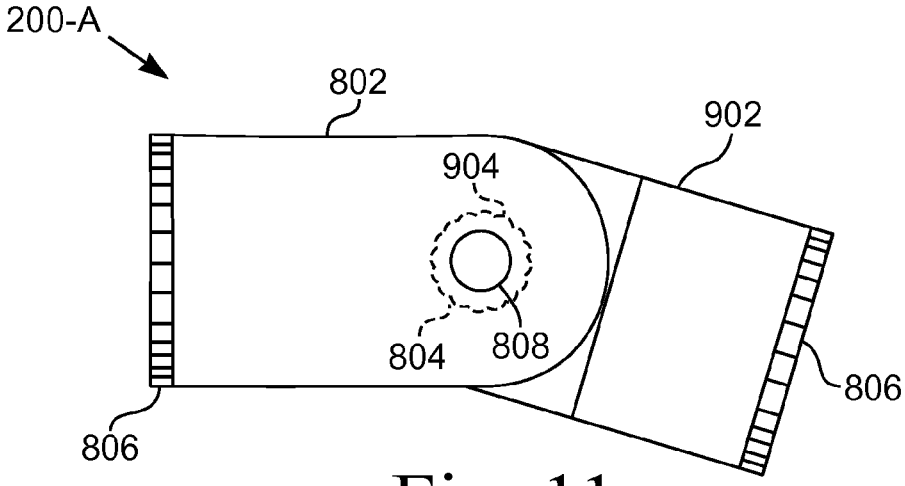
FIG. 11 is a side view of one embodiment of the adjustable connector assembly.

FIG. 8 illustrates a side view of one embodiment of one half of the extension of the adjustable connector assembly 200. FIG. 9 illustrates a side view of one embodiment of the other half of the extension of the adjustable connector assembly 200. FIG. 10 illustrates a cross-sectional view of one embodiment of the extension of an adjustable connector assembly 200-B. FIG. 11 illustrates a side view of one embodiment of the adjustable connector assembly 200-A. The adjustable connector assembly 200 includes two adjustable connector halves, or members, 802, 902 joined together by a fastener 1002 in through-openings 808, 908. The two halves 802, 902 together are an extension between the clamp, or mounting member, 202 and the accessory 150. The socket 904 and plug 804 of the two halves 802, 902 form a lockable, articulated joint allowing the longitudinal axes of the two halves 802, 902 to assume an angle relative to each other and not be coaxial, as illustrated in FIG. 11. In the embodiment illustrated in FIGS. 8, 9, and 11, the fastener 1002 is secured with a nut.

Each adjustable connector half 802, 902 has a cylindrical shaped body with one rounded end 812, 912 and an opposite end having a rosette-shaped plug 806. Each rounded end 812, 912 has the cylindrical shape bisected such that the two halves 802, 902 mate to form one generally cylindrical adjustable connector assembly 200. The flat surface of the rounded end 812 of one coupling half 802 has a rosette-shaped socket 804 that receives a correspondingly shaped plug 904 protruding from the flat surface of the rounded end 912 of the other coupling half 902. The socket 804 and the plug 904 each have an axis of rotation, which is co-axial with the longitudinal axis of the through-openings 808, 908. The axis of rotation intersects and is perpendicular to the longitudinal axis of each member 802, 902.

The embodiment of the adjustable connector assembly 200-B illustrated in FIG. 10 shows a blind threaded hole 1008 in one adjustable connector half 802. The blind hole 1008 is threaded to receive a fastener 1002 inserted in the through-opening 908. In one embodiment, the fastener 1002 is a bolt with a knob 1004 on the end to facilitate manually tightening the joint of the plug 904 and socket 804. In another embodiment, the fastener 1002 is a bolt with a counter-sunk head in the adjustable connector half 902 to secure the joint of the plug 904 and socket 804.

Figure 12A:
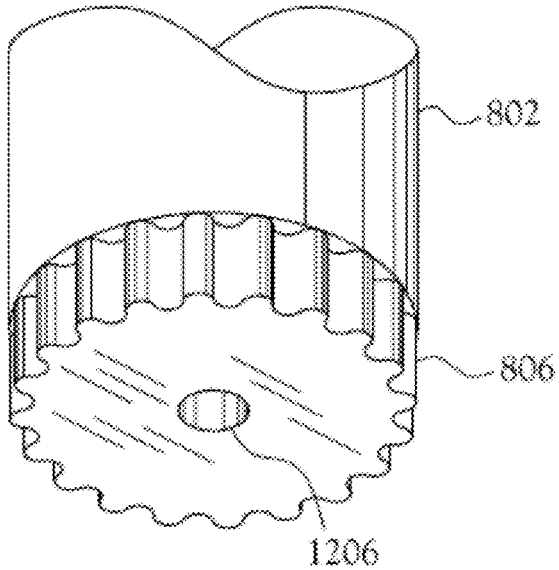
FIG. 12A is a partial perspective view of the end of one half of the adjustable connector.
Figure 12B:
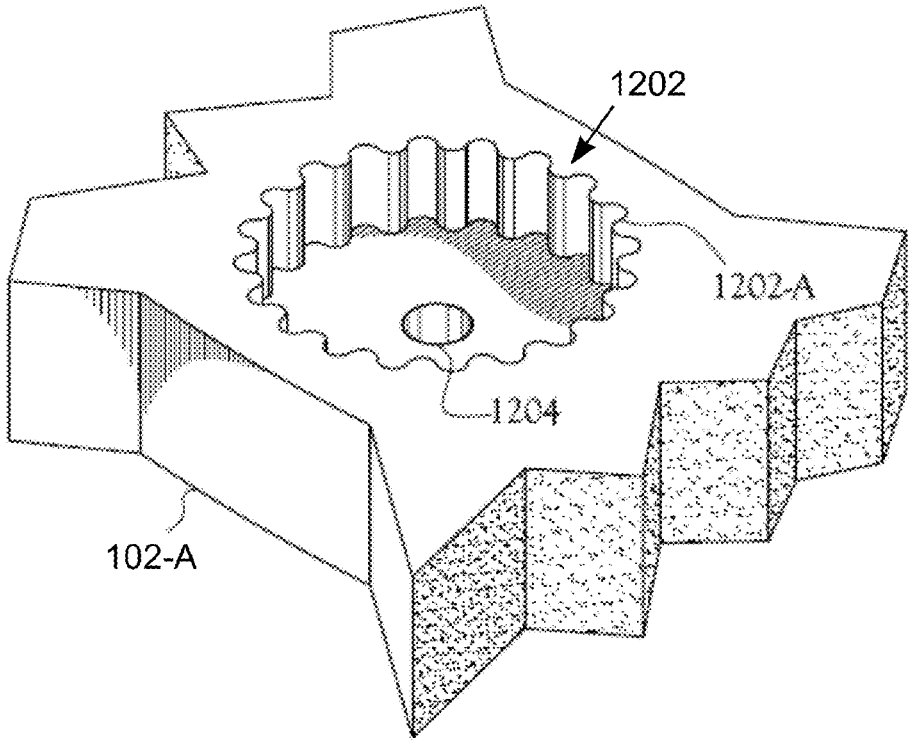
FIG. 12B is a partial perspective view of one embodiment of the end plate.

FIG. 12A illustrates a partial perspective view of one end of one member 802 of the adjustable connector assembly 200. FIG. 12B illustrates a partial perspective view of one embodiment of the side panel, or end plate, 102-A of the clamping assembly 150. The side panel 102-A of the wakeboard clamping assembly 150 is used as an example of an accessory that is secured to a boat by the adjustable connector assembly 200. It is noted that the clamp 202 also includes a socket 1202 that receives a plug 806 on one end of the adjustable connector assembly 200. The socket 904 and the plug 804 of the two members 802, 902 of the adjustable connector assembly 200 have a configuration similar to that illustrated in FIGS. 12A and 12B.

Each end of the adjustable connector assembly 200 has a rosette-shaped plug 806 and a threaded opening 1206 for receiving a bolt or other fastener. The plug 806 has a cylindrical portion with a series of rounded protrusions evenly distributed around a circumference of the cylindrical portion.

The rosette-shaped plug 806 is received by a corresponding rosette-shaped socket 1202-A in the side panel 102-A. The socket 1202-A has a cylindrical recess with a series of rounded recesses evenly distributed around an inside circumference of the cylindrical recess. The rosette-shaped socket 1202-A has a through-opening 1204 through which a bolt or other fastener passes for securing the coupling assembly 200 to the side panel 102. The coupling assembly 200 is rotated about its longitudinal axis to a desired orientation before the plug 806 engages the socket 1202-A.

Figure 13:
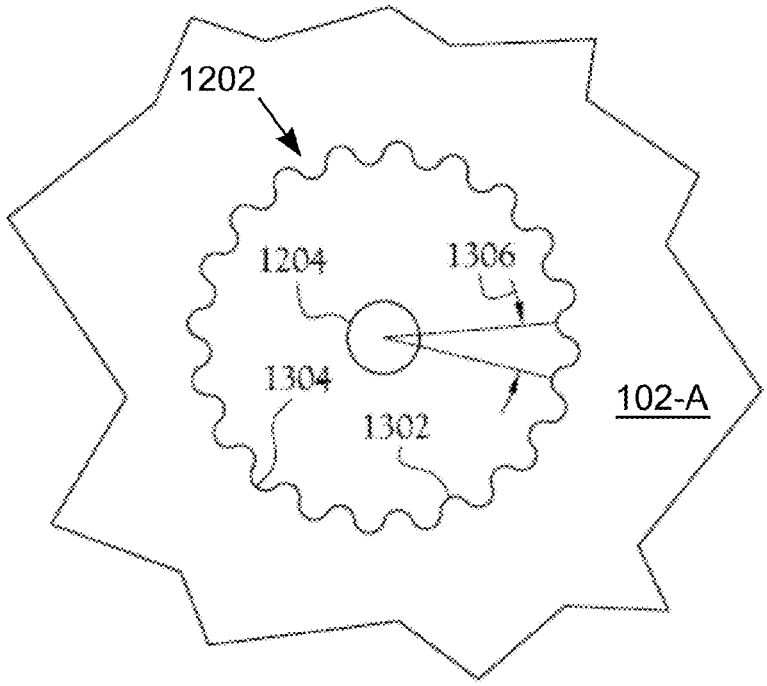
FIG. 13 is a plan view of one embodiment of the end plate.

FIG. 13 illustrates a plan view of one embodiment of the rosette-shaped socket 1202-A in the end plate 102. In the illustrated embodiment, the wall of the socket 1202-A has a convoluted surface with a series of rounded protrusions, or protuberances, 1302 adjacent to rounded recesses, or valleys, 1304. The rosette-shaped socket 1202-A resembles a sine curve that follows a circular axis. The plug 806 at the end of the coupling half 802, 902 has a corresponding shape that mates with the socket 1202. That is, the plug 806 has a cylindrical end with a series of rounded protrusions dimensioned and configured to engage the rounded recesses 1304 of the socket 1202-A.

The rosette-shape of the plug 802 and the corresponding socket 1202 prevent the adjustable connector assembly 200 from rotating relative to each other after engagement. The regular pattern of protrusions 1302 and recesses 1304 allow the adjustable connector assembly 200 to be axially rotated to a desired position before being secured to the plate 102. The radial angle 1306 between the peaks of the rounded protuberances 1302 defines the minimum step in which the adjustable connector assembly 200 can be rotated before engaging the socket 1202. The illustrated embodiment includes twenty rounded protuberances 1302; therefore, the radial angle 1306 is 18°. Accordingly, the adjustable connector assembly 200 can be rotated about its longitudinal axis in steps of 18° increments before the adjustable connector plug 806 is inserted in the socket 1202. In this manner, the alignment of the side panel, or plate, 102 relative to the adjustable connector assembly 200 is adjusted and selected during assembly.

Figure 14:
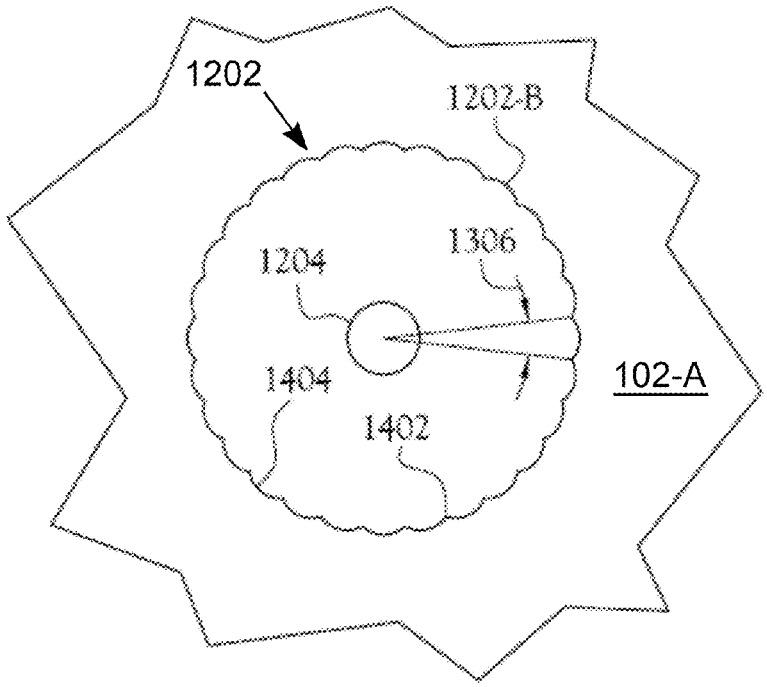
FIG. 14 is a plan view of another embodiment of the end plate.

FIG. 14 illustrates a plan view of another embodiment of the rosette-shaped socket 1202-B in the end plate 102. The socket 1202-B has a series of rounded recesses, or valleys, 1404 with each pair of recesses 1404 meeting at a peak 1402. The plug 806 has a complementary shape with a series of rounded protrusions and mates with the socket 1202-B. In a similar manner as illustrated in FIG. 13, this embodiment has an angular step 1306 of adjustment defined by the angular separation between the peaks 1402.

The strength of the connection formed by the plug 806 engaging the socket 1202 is determined in part by the radial contact surfaces of the sidewalls of the plug 806 and socket 1202. The embodiment illustrated in FIG. 13 has a theoretically greater strength to resist rotary failure than the embodiment illustrated in FIG. 14. That is, it takes greater force to cause the plug 806 to rotate within the socket 1202-A than it would for the embodiment of FIG. 14, given the same materials and general dimensions. It is noted that not all applications require such great strength for a joint.

Those skilled in the art will recognize that the amount of rotary adjustment of the adjustable connector assembly 200 relative to the side plate 102 and the clamp half 202 is controlled by varying the size of the radial angle 1306. The radial angle 1306 is decreased by increasing the number of rounded protuberances 1302 for one embodiment and the number of peaks 1402 in another embodiment.

In another embodiment, the socket 1202 has angled, or substantially planar, recesses or valleys and the plug 806 has a complementary shape that engages the socket 1202. In one such an embodiment, the plug 806 has a star-shaped or gear-shaped pattern and the socket 1202 has a corresponding mating shape.

The rosette-shaped socket 804 and the protruding plug 904 of the adjustable connector assembly 200 operate on the same principles as illustrated in FIGS. 12A to 14. That is, the socket 804 in the rounded end 812 has a rosette-shape, although dimensionally smaller, that is similar to the embodiments of the sockets 1202 illustrated in FIGS. 13 and 14. The angle between the longitudinal axis of each adjustable connector half 802, 902 is defined by the radial angle 1306 of the peaks 1302, 1402 in the rosette-pattern of the plug 904 and socket 804. In order to adjust the adjustable connector assembly 200, the fastener 1002 is loosened such that the plug 904 is disengaged from the socket 804 and then the two adjustable connector halves 802, 902 are rotated about the center of the through-openings 808, 908 that receive the fastener 1002 until the adjustable connector assembly 200 has the desired configuration. The plug 904 then engages the socket 804 and the fastener 1002 is tightened such that the two adjustable connector halves 802, 902 are fixed relative to each other.

Accordingly, the adjustable connector assembly 200-A, 200-B has three degrees of freedom or adjustability. The adjustable connector assembly 200 two opposing plugs 806 that engage sockets 1206 in the clamp 202 and the side plate 102. Additionally, the socket 904 and the plug 804 of the two members 802, 902 of the adjustable connector assembly 200 allow the longitudinal axes of the two halves 802, 902 of the adjustable connector assembly 200 to assume an angle relative to each other. A fourth degree of freedom is available by the clamp 202, 204 being able to rotate about a tubular member before being secured to that member.

Figure 15:
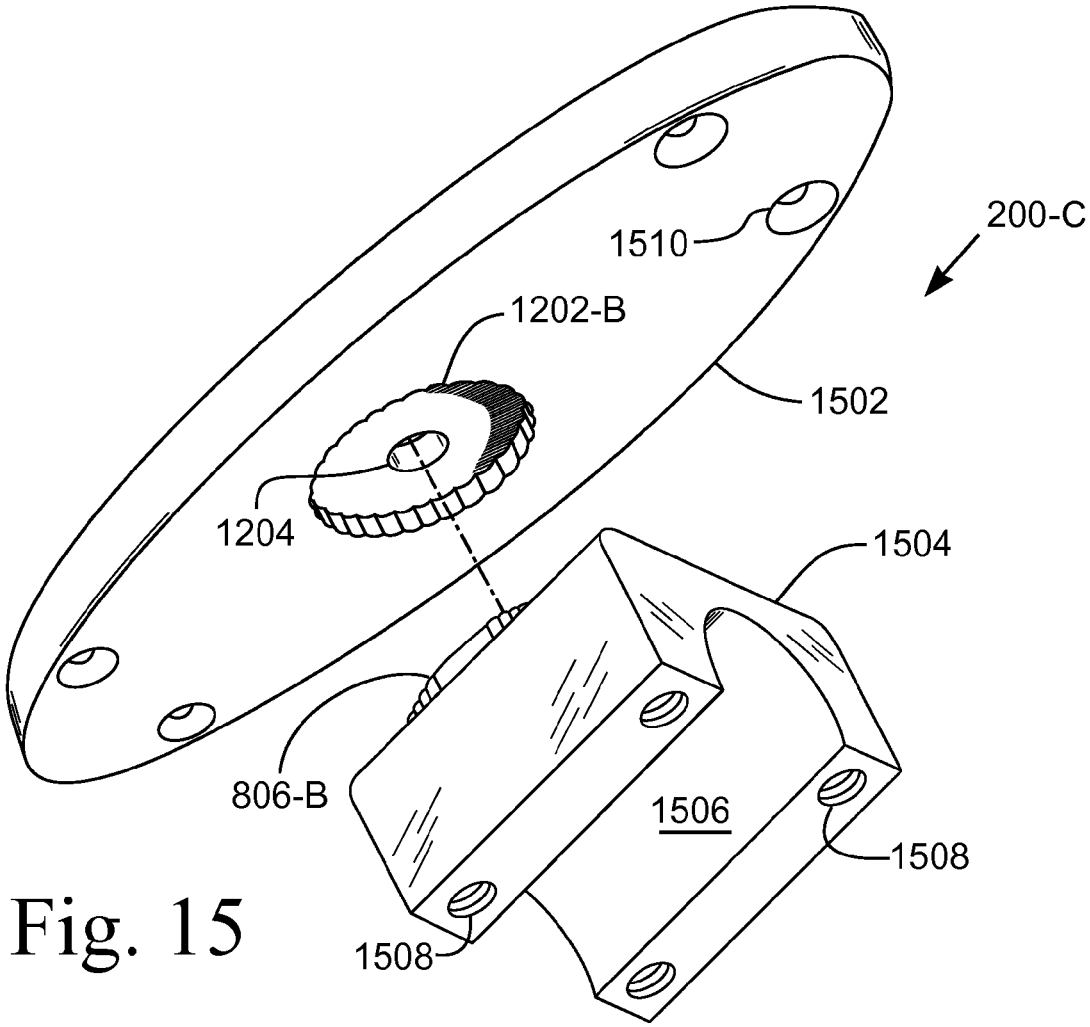
FIG. 15 is a perspective view of another embodiment of the adjustable connector assembly.

FIG. 15 illustrates a perspective view of another embodiment of an adjustable connector assembly 200-C. An accessory base 1502 has a socket 1202-B and several countersunk mounting holes 1510. The illustrated embodiment of the accessory base 1502 is an oval plate to which a pair of wakeboard holder forks attach by way of fasteners in the mounting holes 1510. In other embodiments, the accessory base 1502 supports other boat accessories, for example, a speaker or a light, or is a member included in such an accessory. The accessory base 1502 includes an opening 1204 that receives a fastener.

A plug 806-B protrudes from a clamping, or mounting, base 1504. The clamping, or mounting, base 1504 is dimensioned and configured to be secured to the boat or a supporting member attached thereto. The plug 806-B has a rosette-shape that corresponds to the socket 1202-B. The clamping base 1504 has a half-cylindrical opening 1506 that cooperates with a corresponding half-cylindrical opening in a corresponding clamping member to receive a tubular member, such as a boat tower. The clamping base 1504 includes four threaded openings 1508 that receive threaded fasteners for securing the clamping base 1504 to its corresponding clamping member. In other embodiments, the mounting base 1504 is dimensioned and configured to attach to a surface and/or fixture of the boat. For example, the mounting base 1504, in one such embodiment, is a plate with mounting holes for fasteners to attach the plate to the boat.

In the illustrated embodiment, one face 1604 of the clamping base 1504 is adjacent the face of the accessory base 1502 when the plug 806-B engages the socket 1202-B. In another embodiment, the plug 806-B is separated from the body of the clamping base 1504 by an extension. In one such embodiment, the extension is a cylindrical member positioned between the rosette-shaped plug 806-B and the face 1604 of the clamping base 1504.

In another embodiment, the socket 1202 and the plug 806 are switched between the accessory base 1502 and the clamping base 1504. That is, the socket 1202 is incorporated in the clamping base 1504 and the plug is incorporated in the accessory base 1502.

Figure 16:
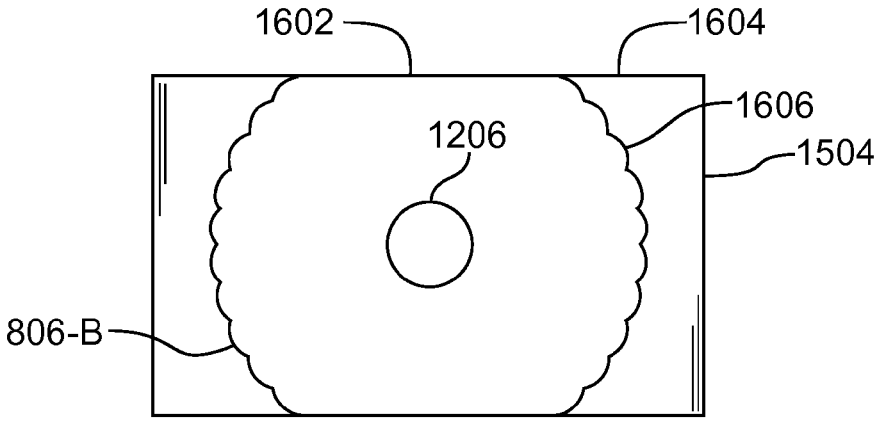
FIG. 16 is an end view of one embodiment of a plug protruding from a clamping base.

FIG. 16 illustrates an end view of one embodiment of a plug protruding from a clamping base 1504. In the illustrated embodiment, the clamping base 1504 has a width less than the diameter of the plug 806-B. Sufficient rounded protrusions 1606 remain to engage the rounded recesses 1404 in the socket 1202-B to securely fix the plug 806-B in the socket 1202-B.

The clamping base 1504 includes an opening 1206 for receiving a fastener. The opening 1206 in the clamping base 1504 has an axis co-axial with the axis of the opening 1204 in the accessory base 1502. In various embodiments, one of the openings 1206, 1204 is threaded or the openings 1206, 1204 are through-openings that receive a threaded fastener that is secured with a nut.

The adjustable connector assembly 200 includes various functions. The function of preventing rotation is implemented, in one embodiment, by the protrusions 1606 on the plug 806 engaging the recesses 1304, 1404 in the socket 1202.

The function of securing the plug 806 in the socket 1202 is implemented, in one embodiment, by a fastener engaging the openings 1204, 1206.

The function of attaching one of the plug 806 or the socket 1202 to a boat is implemented, in one embodiment, by the clamping member or base 202, 204, 1504, which is configured to attach to a tubular member such as a tower, stanchion, or railing. In other embodiments, the member or base 202, 1504 attaches to the boat by fasteners or other mounting means.

From the foregoing description, it will be recognized by those skilled in the art that an adjustable connector assembly 200 has been provided. The adjustable connector assembly includes a first member having a plug 806 and a second member having a socket 1202. The plug has a series of protrusions 1606 arranged on a cylindrical shape. The socket 1202 has a series of recesses 1304, 1404 configured to receive the protrusions 1606 of the plug 806. The plug 806 and the socket 1202 have openings 1204, 1206 that receive a fastener. The first member 202, 102, 1502, 1504 is one of a clamping base 202, 1504 or an accessory member 102, 1502. The second member 202, 102, 1502, 1504 is the other corresponding one of a clamping base 202, 1504 or an accessory member 102, 1502.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for adjustably connecting a boating accessory to a watercraft, said apparatus comprising:

a first member having a plug protruding therefrom, said plug having a rosette configuration having a cylindrical portion with a plurality of arcuate protrusions evenly distributed around a circumference of said cylindrical portion, said cylindrical portion having a plug opening being coaxial with said cylindrical portion, said first member selected from a group including an attachment base and an accessory base, said attachment base dimensioned and configured to attach to the watercraft, said accessory base dimensioned and configured to support the boating accessory, said accessory base being a member of a wakeboard holder;

a second member having a socket, said socket having a cylindrical recess and a bottom, said cylindrical recess having with a plurality of recesses evenly distributed around an inside circumference of said cylindrical recess, said cylindrical recess dimensioned and configured to receive said cylindrical portion of said plug with said plurality of protrusions engaging said plurality of recesses, said bottom extending away from said inside circumference of said cylindrical recess, said cylindrical recess bottom having a socket opening coaxial with said cylindrical recess, said second member being the other of said attachment base or said accessory base; and a fastener engaging said plug opening and said socket opening, said fastener retaining said plug in said socket, and said plug not removable from said first member when said plug is not engaging said socket.

2. The apparatus of claim 1 further including an extension member between a face of said first member and said plug.

3. The apparatus of claim 2 wherein said extension member includes a first extension member portion and a second extension member portion joined with an articulated joint.

4. The apparatus of claim 3 wherein said articulated joint includes said first extension member portion having a socket with an axis of rotation perpendicular to a longitudinal axis of said first extension member portion and said second extension member portion having a corresponding plug with an axis of rotation perpendicular to a longitudinal axis of said second extension member portion, said plug having a rosette shape, said socket dimensioned and configured to engage said plug, said socket and said plug each having a coaxial opening, and a fastener engaging said coaxial openings of said socket and said plug.

5. The apparatus of claim 1 further including a third member attached to said attachment base, said third member and said attachment base defining a cylindrical opening dimensioned and configured to clamp onto a tubular member attached to the watercraft.

6. An apparatus for adjustably connecting a boating accessory to a watercraft, said apparatus comprising:

an attachment base having a plug protruding therefrom, said plug having a rosette configuration having a cylindrical portion with a plurality of rounded protrusions evenly distributed around a circumference of said cylindrical portion, said cylindrical portion having a plug opening being coaxial with said cylindrical portion, said attachment base dimensioned and configured to attach to the watercraft, said attachment base is a plate, said socket recessed in said plate, and said plate is configured to attach to a support member;

an accessory base having a socket, said socket having a cylindrical recess with a plurality of recesses evenly distributed around an inside circumference of said cylindrical recess, said cylindrical recess dimensioned and configured to receive said cylindrical portion of said plug with said plurality of protrusions engaging said plurality of recesses, said cylindrical recess having a socket opening coaxial with said cylindrical recess, said accessory base dimensioned and configured to support the boating accessory; and a fastener engaging said plug opening and said socket opening, said fastener retaining said plug in said socket, and said plug fixed to said attachment base when said plug is not engaging said socket.

7. The apparatus of claim 6 wherein each one of said plurality of protrusions of said plug have at least one substantially planar surface and each one of said plurality of recesses of said socket have at least one corresponding substantially planar surface.

8. The apparatus of claim 6 further including an extension member between a face of said attachment base and said plug.

9. The apparatus of claim 6 further including an extension member between a face of said attachment base and said plug, said extension member includes a first extension member portion and a second extension member portion joined with an articulated joint.

10. The apparatus of claim 6 wherein said accessory base is a member of a wakeboard holder.

11. The apparatus of claim 6 further including a clamp member attached to said attachment base, said clamp member and said attachment base defining a cylindrical opening dimensioned and configured to clamp onto a tubular member attached to the watercraft.

12. An apparatus for adjustably connecting a boating accessory to a watercraft, said apparatus comprising:

a first member having a plug, said plug having a cylindrical portion with a plurality of protrusions evenly distributed around a circumference of said cylindrical portion, said cylindrical portion having a plug opening being coaxial with said cylindrical portion, said first member selected from a group including an attachment base and an accessory base, said attachment base dimensioned and configured to attach to the watercraft, said accessory base dimensioned and configured to support the boating accessory;

a second member having a socket, said socket having a cylindrical recess with a plurality of recesses evenly distributed around an inside circumference of said cylindrical recess, said cylindrical recess dimensioned and configured to receive said cylindrical portion of said plug with said plurality of protrusions engaging said plurality of recesses, said cylindrical recess having a socket opening coaxial with said cylindrical recess, said second member being the other of said attachment base or said accessory base; and a fastener engaging said plug opening and said socket opening, said fastener retaining said plug in said socket;

wherein said accessory base is a member of a wakeboard holder.

13. The apparatus of claim 12 wherein said accessory base is a plate, and said socket recessed in said plate.

* * * * *